United States Patent [19]

Abel et al.

[11] 3,967,041

[45] June 29, 1976

[54] MODIFYING TEXTILES AND FIBERS

[75] Inventors: Heinz Abel, Reinach, Switzerland; Bryan Dobinson; George Edward Green, both of Cambridge, England; Melvin Harris, Dornach, Switzerland; Bernard Peter Stark; Kenneth Winterbottom, both of Cambridge, England

[73] Assignee: Ciba-Geigy Corporation, Ardsley, N.Y.

[22] Filed: Aug. 30, 1973

[21] Appl. No.: 392,921

[30] Foreign Application Priority Data

Sept. 1, 1972 United Kingdom ..... 40647/72

[52] U.S. Cl. ..... 428/419; 260/79.2 NV; 427/389; 428/474

[51] Int. Cl.[2] ..... B32B 27/06; B32B 27/32

[58] Field of Search ..... 117/141, 161 UC; 260/79.5 NV; 427/389; 428/270, 290, 419, 473, 474

[56] References Cited

UNITED STATES PATENTS

| | | | |
|---|---|---|---|
| 3,676,195 | 7/1972 | Kehr et al. | 117/140 X |
| 3,676,283 | 7/1972 | Kehr et al. | 161/88 |
| 3,703,352 | 11/1972 | Dobinson et al. | 117/141 X |
| 3,706,527 | 12/1972 | Dobinson et al. | 117/141 X |
| 3,714,290 | 1/1973 | Kehr et al. | 260/79.5 X |
| 3,783,016 | 1/1974 | Randall et al. | 117/141 X |

FOREIGN PATENTS OR APPLICATIONS

| | | | |
|---|---|---|---|
| 1,312,530 | 4/1973 | United Kingdom | 427/387 |

*Primary Examiner*—Cameron K. Weiffenbach
*Assistant Examiner*—R. Eugene Varndell, Jr.
*Attorney, Agent, or Firm*—Joseph G. Kolodny; Edward McC. Roberts; Prabodh I. Almaula

[57] ABSTRACT

A process for finishing keratinous material, especially rendering it shrink-resistant or imparting to it durably pressed effects, comprises 1. treating the material with a polythiol ester of the formula

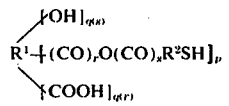

where $R^1$ represents an aliphatic or araliphatic hydrocarbon radical of at least 2 carbon atoms, which may contain not more than one ether oxygen atom, $R^2$ represents a hydrocarbon radical, $p$ is an integer of from 2 to 6, $q$ is zero or a positive integer of at most 3, such that $(p + q)$ is at most 6, and $r$ and $s$ each represent zero or 1 but are not the same, and 2. curing the polythiol ester on the material by means of a polyene containing, per average molecule, at least two ethylenic double bonds each $\beta$ to an oxygen, nitrogen, or sulfur atom, the sum of such ethylenic double bonds in the polyene and of the mercaptan groups in the polythiol ester being more than 4 and the combined weight of the polyene and the polythiol ester being from 0.5 to 15% by weight of the keratinous material treated.

18 Claims, No Drawings

MODIFYING TEXTILES AND FIBERS

This invention relates to a process for modifying textiles and fibres of keratinous material.

Processes for rendering keratinous material resistant to shrinkage are known, some of which comprises application of a resin to the material in fabric or fibre form. Shrink-resist processes stabilise the dimensions of keratinous materials against shrinkage due to felting.

Processes for imparting durably-pressed effects to keratinous material are also known and many of them employ resins the same or similar to those used in shrink-resist processes. These processes stabilise the shape and surface smoothness of the material and prevent deformation on contact with water. In some processes the desired shape is imparted to the keratinous material before the resin is applied and curing takes place whilst the material is maintained in the desired shape; in others, the resin is applied and cured after the desired shape has been imparted. Methods of imparting the desired shape are well known, and involve the use of setting agents such as steam, reducing agents, and bases.

A desirable feature of shrink-resist and durable press processes is that the keratinous material so treated should be washable by conventional washing procedures, particularly in domestic washing machines. To be machine-washable, the finish on the treated material should withstand vigorous agitation in warm or hot water containing detergents, and this requirement sets a severe test for the treatments.

It is known to use certain polythiol esters in durable press and shrink-resist processes, these esters curing on the keratinous fibre. It is also known that the rate of cure may be largely controlled by selection of an appropriate catalyst.

However, a disadvantage of these esters is that their effect is not always reproducible, for reasons that are not fully understood. We have now found that, by the application of certain polyunsaturated substances in conjunction with the polythiol esters, good results can be obtained more consistently. Also, the amount of polythiol ester needed to impart the desired effect is reduced, which favourably influences the handle and the odour of the treated material.

Accordingly, the present invention provides a process for finishing keratinous material, especially keratinous fibrous material, such as imparting durably pressed properties or resistance to shrinkage on washing, which comprises 1. treating the material with a polythiol ester of the formula

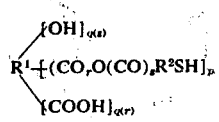

I where $R^1$ represents an aliphatic or araliphatic hydrocarbon radical of at least 2, and preferably at most 60, carbon atoms, which may contain not more than one ether oxygen atom, $R^2$ represents a hydrocarbon radical, $p$ is an integer of from 2 to 6, $q$ is zero or a positive integer of at most 3, such that $(p + q)$ is at most 6, and $r$ and $s$ each represent zero or 1 but are not the same, 2. curing the polythiol ester on the material by means of a polyene containing, per average molecule, at least two ethylenic double bonds each $\beta$ to an oxygen, nitrogen, or sulphur atom, the sum of such ethylenic double bonds in the polyene and of the mercaptan groups in the polythiol ester being more than 4, preferably from 5 to 8, and the combined weight of the polyene and the polythiol ester being from 0.5 to 15% by weight of the keratinous material treated.

This invention also provides keratinous material bearing thereof from 0.5 to 15% by weight of a product comprising a said polythiol ester cured with a said polyene.

Preferred polythiol esters are those of formula I where $R^2$ represents an alkylene group.

One further preferred class comprises those esters of formula

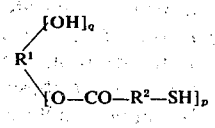

II where $R^1$, $R^2$, $p$, and $q$ have the meanings previously assigned, and yet further preferred are such compounds where $q$ denotes zero.

Also preferred are polythiol esters which are of the formula

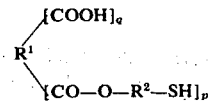

III where $R^1$, $R^2$, $p$, and $q$ have the meanings previously assigned, especially those where $q$ denotes zero.

Polythiol esters of formula II are, in general, known substances, and are readily prepared by partial or complete esterification of a polyol $R^1(OH)_{p+q}$ with a mono-mercaptocarboxylic acid HOOC-$R^2$-SH. The mercaptocarboxylic acid is preferably thioglycollic acid, 2- or 3-mercaptopropionic acid, or mixtures thereof, although other mercaptoacids such as mercaptoundecylic acid, mercaptostearic acid, and o-mercaptobenzoic acid may also be used.

Polyols suitable for use as starting materials include glycerol, 1,1,1,-trimethylolethane, 1,1,1-trimethylolpropane, hexane-1,2,5-triol, hexane-1,2,6-triol, pentaerythritol, dipentaerythritol, mannitol, sorbitol, styrene-allyl alcohol copolymers, ethylene glycol, propylene glycol, propane-1,3-diol, and dipropylene glycol, and $R^1$ accordingly most preferably represents the residue, after removal of $(p + q)$ hydroxyl groups of the aforesaid polyols.

Polythiol esters of formula III are also, in general, known substances, and are readily prepared by partial or complete esterification of a polycarboxylic acid $R^1(COOH)_{(p+q)}$ with a hydroxythiol HO-$R^2$-SH.

Polycarboxylic acids which can be used as starting materials include succinic, adipic, glutaric, sebacic, azelaic, tricarballylic, mellitic, trimellitic, and pyromellitic acid, and also dimerised or trimerised linoleic acid and polymers or copolymers of monoethylenically unsaturated acids and anhydrides such as acrylic acid, methacrylic acid, and maleic anhydride.

Preferred among the compounds of the foregoing formulae are those where $R^1$ denotes an aliphatic hydrocarbon radical of at most 6 carbon atoms and $R^2$ contains at most 6 carbon atoms, and particularly those of formula II, where $R^2$ denotes $-CH_2-$, $$-\underset{\underset{CH_3}{|}}{CH}-,$$

or $-CH_2CH_2-$, and of formula III, where $R^2$ denotes $-CH_2CH_2-$ or $$\underset{\underset{CH_3}{|}}{CH_2CH}-,$$

As already indicated, the polyenes employed contain at least two ethylenic double bonds, each $\beta$ to a heteroatom: these heteroatoms may be the same or different.

Polyenes preferred for the purpose of this invention have average molecular weights in the range 250 to 10,000, and further preferred polyenes are those having at least two ethylenic double bonds each $\alpha$ to a carbonyloxy group, particularly those of the formula $$\left[R^3-(\text{O-alkylene})_d-O-(CH_2\underset{\underset{R^4}{|}}{C}HCH_2O)_b-R^5\right]_c \qquad \text{IV}$$

where $d$ is zero or a positive integer of value such that the average molecular weight of the polyene does not exceed 10,000, $b$ is zero or 1, $c$ is an integer of at least 1 but usually not more than 6, and is preferably 2 or 3, $R^3$ denotes the radical remaining after removal of $c$ OH groups from a compound having at least $c$ alcoholic or phenolic hydroxyl groups or the acyl radical remaining after removal of $c$ OH groups from a compound having at least $c$ COOH groups, each 'alkylene' group contains a chain of at least 2 and at most 6 carbon atoms between consecutive oxygen atoms, $R^4$ represents a group of formula —OH or $-OOCR^6$, $R^5$ represents —H, an acyl group, or the residue, after removal of an —OH group, of an alcohol, with the provisos that $R^3$ and $R^5$ do not both represent acyl if $b$ and $d$ both denote zero and that $R^5$ does not represent —H if $b$ is 1, and $R^6$ represents —H, or a monovalent hydrocarbon group which may bear carboxyl or alkoxycarbonyl substituents, there being a total of at least two ethylenic double bonds $\alpha$ to carbonyloxy group in the group $R^3$, and/or in the $c$ groups $R^5$ and/or in the $b\,c$ groups $R^6$ if present.

Alkylene units in individual poly(oxyalkylene) chains may be the same or different and they may be substituted by e.g., phenyl or chloromethyl groups. Preferably they are $-C_2H_4-$ or $-C_3H_6-$groups.

Yet further preferred are polyenes of formula IV in which $R^5$ represents the monoacyl residue of a saturated or ethylenically unsaturated mono-or di-carboxylic acid, and particularly those where $R^5$ denotes a group of formula $$-\overset{\overset{O}{\|}}{C}-\underset{\underset{R^7}{|}}{C}=CHR^8 \qquad \text{V}$$

where $R^7$ denotes —H, —Cl, —Br, or an alkyl group of 1 to 4 carbon atoms, and $R^8$ denotes —H, —COOH, or a group of the formula $$-\overset{\overset{O}{\|}}{C}O-(CH_2\underset{\underset{R^4}{|}}{C}HCH_2O)_b-R^9 \qquad \text{VI}$$

where $R^4$ and $b$ have the meanings previously assigned and $R^9$ denotes —H, an alkyl, aryl, aralkyl, or alkenyl hydrocarbon group, or an aliphatic, aromatic, or araliphatic acyl group, such that the group $R^8$ contains not more than 24 carbon atoms.

Preferably $R^6$ represents a group containing from 2 to 16 carbon atoms and bearing either one —COOH group or one alkoxycarbonyl group containing from 1 to 13 carbon atoms, and especially it denotes —CH = CHCOOH or $-CH_2CH_2COOH$, while $R^3$ preferably represents an aliphatic radical containing from 3 to 60 carbon atoms, especially a saturated hydrocarbon radical of not more than 6 carbon atoms: when $R^3$ represents the residue of a polyhydric phenol it is preferably of one of the formulae

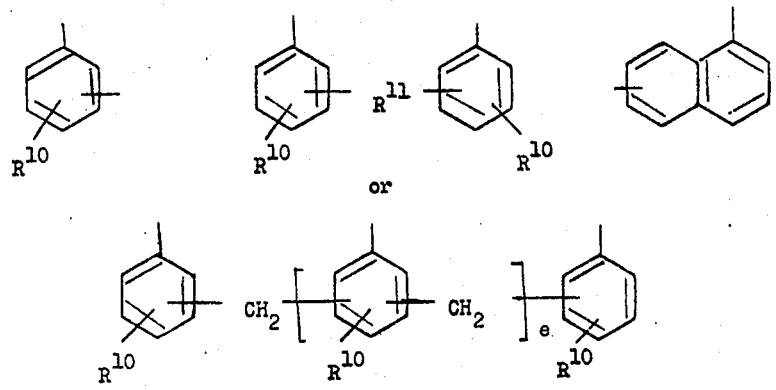

where each $R^{10}$ denotes —H, —Cl, —Br, or an alkyl or alkenyl group of 1 to 9 carbon atoms, $R^{11}$ denotes a carbon-carbon bond, an alkylene hydrocarbon group of from 1 to 4 carbon atoms, or an ether oxygen atom, and

*e* is an integer of from 1 to 4.

Compounds of formula IV, where $R^3$ is the radical remaining after removal of *c* OH groups from an alcohol containing at least *c* alcoholic hydroxyl groups or, providing *d* is at least one, the acyl radical remaining after removal of *c* OH groups from a carboxylic acid containing at least *c* carboxylic acid groups or the radical remaining after removal of *c* OH groups from a phenol containing at least *c* phenolic hydroxyl groups, are obtainable by esterifying the alcohol of formula $$R^3\text{-}[(\text{O-alkylene})_d\,OH]_c \qquad \text{VII}$$

with a carboxylic acid of formula $HOR^5$ or its anhydride or acid chloride, in the case where *b* is zero, while those where *b* is 1 are obtainable by converting the alcohol of formula VII into its glycidyl ether of formula

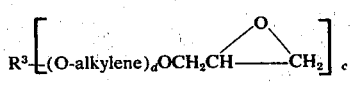

$$R^3\text{-}\left[(\text{O-alkylene})_d OCH_2CH\text{—}CH_2\right]_c \qquad \text{VIII}$$

followed by opening of the indicated epoxide ring through reaction with the carboxylic acid of formula $HOR^5$.

Compounds of formula IV, where $R^3$ is the acyl radical remaining after removal of *c* OH groups from a carboxylic acid containing at least *c* carboxylic acid groups and *d* is zero, are obtainable by esterification of the carboxylic acid of formula $R^3(OH)_c$ or its anhydride with an alcohol formula $R^5OH$, were *b* is zero, while those where *b* is 1 are obtainable by reaction of the acid $R^3(OH)_c$ with a glycidyl ether or a glycidyl ester.

Compounds of formula IV, where $R^3$ is the aryl radical remaining after removal of *c* hydroxyl groups from a compound having at least *c* phenolic hydroxyl groups and *b* and *d* are each zero, are obtainable by esterifying the phenol of formula $$R^3(OH)_c \qquad \text{IX}$$

with a carboxylic acid of formula $HOR^5$ or its anhydride or acid chloride, while those where *d* is zero and *b* is 1 are obtainable by converting the phenol of formula IX into its glycidyl ether of formula

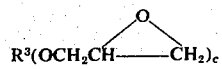

$$R^3(OCH_2CH\text{—}CH_2)_c \qquad \text{X}$$

followed by opening of the indicated epoxide ring through reaction with a carboxylic acid of formula $HOR^5$, or by reaction of the phenol of formula IX with the appropriate glycidyl ether or ester.

Often, better shrinkproofing effects are obtained if the polythiol ester is used in considerable excess rather than in a stoichiometric equivalent amount (on the basis of 1 -SH group per double bond of the polyene), typically a 35–100% excess.

The process of this invention provides fibres or garments which, on being washed in a washing machine, retain their original dimensions and shape. The treated material also has good recovery from wrinkling, which is an important attribute in fabrics employed in making trousers, where there is a strong tendency to wrinkles in the areas of the knee and back of the knee. Of course, wrinkle-resistance is an important advantage in many other garments.

The polyenes and the polythiol ester used, as well as inhibiting or preventing felting shrinkage, also inhibit or prevent relaxation shrinkage, which is an important problem associated with knitted goods.

The term 'keratinous material', as used throughout this specification, includes all forms of keratinous fibres or fabrics and garments made therefrom, e.g., fleeces, tops, card silver, noils, yarns, threads, pile fabrics, non-woven fabrics, woven fabrics, and knitted goods. In most cases fabrics or made-up garments will be treated though it is quite feasible, and may in some circumstances be desirable, to shrinkresist the fibres in the form of tops, for example.

The keratinous material may be virgin or reclaimed. Preferably, though not necessarily, it is sheep's wool; it may also be, for example, alpaca, cashmere, mohair, vicuna, guanaco, camel, and llama hair, or blends of these with sheep's wool. The material to be treated can consist either wholly of keratinous fibres or of blends of these with synthetic fibrous and filamentary material, such as polyamides, polyesters, and poly(acrylonitrile), and with cellulosic, including regenerated cellulosic, material. In general, however, the material should contain at least 30% by weight of keratinous fibres and better results are usually obtained with substantially 100% keratinous fibre-containing material.

Usually the keratinous material is treated simultaneously with the polyene and the polythiol ester, but it is within the ambit of the invention to treat the material with the polyene and the polythiol ester in either sequence.

Many of the polyenes and polythiol esters which can be used in the process of this invention are insoluble in water but can be applied as aqueous dispersions or emulsions. They may also be applied from organic solvents, for example, alcohols, lower ketones, toluene, and halogenated hydrocarbon solvents, especially chlorinated and/or fluorinated hydrocarbons such as the dry cleaning solvents, carbon tetrachloride, trichloroethylene, and perchloroethylene.

Aqueous emulsions which are convenient vehicles for applying the polyenes and the polymercaptans comprise i. a polyene and a polythiol ester as aforesaid and, optionally, ii. an emulsifying agent, and/or iii. a protective colloid such as sodium carboxymethylcellulose, hydroxyethylcellulose, or methyl vinyl ether homopolymers and copolymers with e.g., maleic anhydride.

The amounts of polythiol ester and polyene used depend on the effect desired. Stabilisation of knitted fabrics usually requires from 1 to 10%: a high level of shrink-resistance, crease-setting, and substantial resistance to wrinkling can be achieved on woven fabrics with quantities of, say, up to 5%. Generally, the amount of the polyene used is such to supply up to 1.2 ethylenic double bonds per mercaptan group of the polythiol ester; as already indicated, often the best results are obtained using sufficient polyene to supply from 0.5 to 0.75 ethylenic double bond per mercaptan group. The handle of the treated material, will, of course, depend on the amounts employed, and also on the relative proportions of the polythiol ester and polyene, and by simple experiment the optimum amounts may readily be determined.

The desired effects are not fuly obtainable until the polythiol ester has substantially cured. The curing reaction takes place under acid, neutral or alkaline conditions, typically at pH 3 to 10. Often it is desirable to include a catalyst and ordinarily this catalyst is added at the same time as the polyene and the polythiol ester are applied although it may be applied to the material before or afterwards. The amount of catalyst can vary over wide limits, typically from 0.1 to 20% by weight, calculated on the total weight of the polyene and polythiol ester employed.

Substances found to be useful catalysts include organic or inorganic Brønsted bases and acids, and free-radical catalysts. The last are of general applicability, and include organic and inorganic peroxides and persalts such as benzoyl peroxide, hydrogen peroxide, tert. butyl hydroperoxide, di-isopropyl peroxydicarbonate, and ammonium persulphate. For polyenes which do not contain ethylenic double bonds $\alpha$ to carbonyloxy groups, Brønsted acids may also be used. Examples of suitable such acids are sulphuric, phosphoric, and hydrochloric acids, also aromatic sulphonic acids such as toluene-p-sulphonic acid. For the preferred polyenes, i.e., those having ethylenic double bonds $\alpha$ to carbonyloxy groups, Brønsted bases may be used. Examples of these are primary, secondary, and tertiary amines, such as triethylamine and N-benzyldimethylamine and especially alkanolamines, (e.g., mono-,di-, and tri-ethanolamine) and the alkylenepolymaines, (e.g., ethylenediamine, diethylenetriamine, triethylenetetramine, tetraethylenepentamine, propane-1,2-diamine, propane-1,3-diamine and hexamethylenediamine), also water-soluble inorganic hydroxides, especially sodium hydroxide, quaternary ammonium hydroxides such as tetramethylammonium hydroxide, and inorganic, alkaline-reacting salts such as trisodium phosphate, sodium carbonate, sodium bicarbonate, sodium pyrophosphate, and sodium acetate.

Heating promotes curing, and if especially rapid results are required then temperatures in the range 35° to 180°C may be used.

The polyene and the polythiol ester, and the catalyst if employed, can be applied to the keratinous material in conventional ways. For example, wool tops or fabric may be impregnated by padding or by immersing in a bath, while if garments or garment pieces are to be treated then it is convenient to spray them with solutions or dispersions of the polyene and the polythiol ester, and more convenient still to tumble them in such solutions or dispersions; for the latter method a dry-cleaning machine is particularly useful.

The polythiol ester and the polyene may also be applied to keratinous fibres by exhaustion from an aqueous medium. The term 'exhaustion' as used herein means treating the fibres with an aqueous solution or emulsion of the polyene and the polythiol ester, separately or in admixture, until a major proportion of the polyene and the polythiol ester is deposited on the fibres. Such a treatment can be applied before, simultaneously with, or after dyeing with any anionic dyestuff which will exhaust onto the wool. Exhaustion can be carried out at a pH in the range 2 to 10, especially 4 to 8, and at any temperature from room temperature (say, 20°C) to 100°C (but generally at not more than 50°C) and will normally be complete after 1 to 2 hours.

If a shrink-resist treatment is required, it is usually more convenient to apply the polyene and the polythiol ester to the fabric although, as previously stated, they may be applied to tops, and also card silver or yarn.

The fabric may be "flat set" before or after treatment with the polyene and the polythiol ester and by this means the fabric will, in addition to retaining substantially its original dimensions, also retain its flat smooth appearance during wear and after washing. Of course, flat-setting may not be necessary, or even desirable, with certain types of cloth. Flat-setting is normally carried out by treating the cloth with steam, either at superatmospheric pressure or at atmospheric pressure in the presence of a setting agent and moisture while maintaining the cloth in a flat state: it may also be achieved by applying a reducing agent and a swelling agent, and maintaining the cloth in a flat state during washing off the excess of the reagents. In another method the material is impregnated with a swelling agent (e.g., urea) and an alkanolamine carbonate (e.g., diethanolamine carbonate), dried, and then semi-decatised. If desired, the fabric may be set in the presence of the polyene and the polythiol ester, thus effecting the setting and shrinkproofing treatments simultaneously.

If a durable press treatment is required, there are various ways this may be achieved.

One method is to treat the material with the polyene and the polythiol ester, make the material up into garments or garment pieces, and insert therein folds, using reducing agents, bases, or superheated steam is setting agents, curing being effected before or after inserting the folds. A preferred method comprises treating the made-up garment piece, which already has the crease or pleats imparted thereto, with the polyene and the polythiol ester dissolved in an organic solvent: in this method it is preferred to apply from an organic solvent because treatment with aqueous compositions tends to result in removal of the creases or pleats already set in the fabric. Another method for producing durable press pleats or creases comprises impregnating the fabric with the polyene and the polythiol ester in the area where a fold is to be inserted, imparting the fold, and maintaning the fabric in this position whilst heat and pressure are applied.

A method for flat-setting and shrinkproofing keratinous fabrics comprises treating the fabric with a setting agent and flat-setting it by heating the fabric while wet, impregnating it with the polyene and the polythiol ester from an aqueous medium or aqueous media, drying the fabric, and curing the polyene by means of the polythiol ester. Finally, the fabric is made into garments; creases or pleats can be set therein, if desired, by steaming in the presence of a setting agent such as monoethanolamine sesquisulphite.

Fabrics, especially knitted woollens, may be milled by tumbling them in a dry-cleaning solvent containing the reactants and a controlled amount of water.

The polyenes and polythiol esters used in the process of this invention may be employed in conjunction with antisoiling, antistatic, bacteriostatic, rotproofing, flameproofing, and wetting agents, water-repellents (such as paraffin wax), and fluorescent brightening agents.

If the shrink-resist or durably pressed effect deteriorates on prolonged exposure to light of the treated keratinous material, which might occur, particularly if the polyene has a poly(oxyalkylene) chain, it is desirable to incorporate a stabiliser against such adverse effects of light. Suitable stabilisers include compounds having at least one phenolic hydroxyl group at least one alkyl or alkoxy group of 1 to 8 carbon atoms in the same benzene ring, especially compounds having 1 to 4 benzene rings, at least one of which bears a phenolic hydroxyl group ortho to such an alkyl or alkoxy group. Specific examples of suitable stabilisers include 1,1-bis(3,5-di-tert. butyl-2-hydroxyphenyl)butane, 1,1-bis(3-tert.butyl-2-hydroxyphenyl) butane, 1,1-bis(2-tert.butyl-4-hydroxy-6-methylphenyl)butane, bis(3-tert.butyl-2-hydroxy-5-ethylphenyl)methane, bis(3-tert.butyl-4-hydroxy-6-methylphenyl) sulphide, octadecyl 3-(3,5-di-tert.butyl-4-hydroxyphenyl)-propionate, pentaerythrityl tetrakis(3-(3,5-di-tert.butyl-4-hydroxyphenyl)-propionate), and the nickel complex of formula

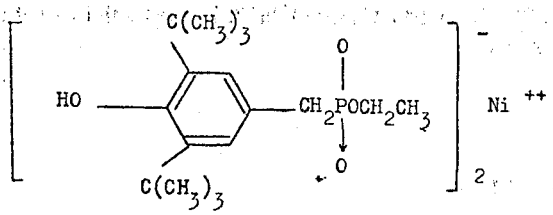

XI

Usually, about 0.1 to 5% by weight of the stabiliser, calculated on the weight of the poly(oxyalkylene)-containing polyene, is employed.

The following Examples illustrate the invention. Unless otherwise specified, parts and percentages are by weight and temperatures are in degrees Celsius.

In the following description of the preparation of certain polyenes:

"Polyol I" denotes a glycerol-propylene oxide adduct (i.e., a poly(oxypropylene) triol) of average molecular weight 4000, "Polyol II", "Polyol III", and "Polyol IV" are similar adducts of average molecular weights 700, 1000, and 600, respectively.

The polyenes used were prepared in the following manner.

Polyolefin A

A mixture of Polyol I (200 g), maleic anhydride (14.7 g), and N-benzyldimethylamine (2 g) was stirred at 120° for 100 minutes. The product, Polyolefin A, is substantially of the formula

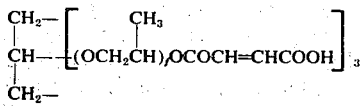

XII where $f$ is an integer of average value 22.5.

Polyolefin B

A mixture of Polyol I (500 g), maleic anhydride (36.5 g), and N-benzyldimethylamine (5 g) was stirred at 120° for 1 hour. To this mixture, stirred at 120°, was then added n-butyl glycidyl ether (49 g, epoxy content 7.1 equiv./kg, i.e., 0.9 molar proportion), and stirring was continued at 120° for 100 minutes, at which time the epoxy content of the product was zero.

The product, "Polyolefin B", is substantially the tris(3-n-butoxy-2-hydroxy-n-propyl) ester of the tris(3-carboxyacrylate) of Polyol I but contains, per average molecule, 0.3 free 3-carboxyacrylate group, i.e., it is substantially of the average formula

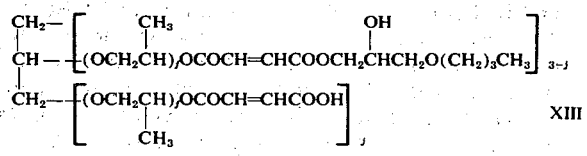

XIII where each $f$ has the meaning previously assigned and $j$ is 0.3.

Polyolefin C

Dimerised linoleic acid (570 g), 284 g of glycidyl methacrylate, 8.5 g of triethylamine, and 1 g of hydroquinone were heated together at 120° for 1¾ hours to form the ester of formula

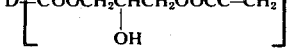

XIV where D is the $C_{34}H_{62}$ radical of dimerised linoleic acid after removal of both carboxyl groups.

The dimerised linoleic acid employed had an average molecular weight of about 570 and a carboxyl content of about 3.4 equiv./kg.

Polyolefin D

This was prepared by the same method as was polyolefin B using, however, 26.5 g (i.e. 0.5 molar proportion) of n-butyl glycidyl ether. Polyolefin D therefore contains 1.5 free 3-carboxyacrylate groups and 1.5 3-carboxyacrylate groups esterified by 3-n-butoxy-2-hydroxypropyl groups per average molecule, and may be represented by the average formula XIII where each *f* has the meaning previously assigned and *j* is 1.5.

Polyolefin E

The triglycidyl ether of Polyol I (having an epoxy content of 0.58 equiv./kg) (200 g), methacrylic acid (10 g), triethylamine (2 g), and hydroquinone (0.2 g) were stirred at 120° for 3 hours, at which time the epoxy content of the product had fallen to zero.

Polyolefin E is substantially the tris(3-methacrylyloxy-2-hydroxy-n-propyl) ether of Polyol I, i.e., substantially of the formula

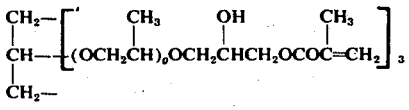

XV where *g* has a value of 22.5.

Polyolefin F

Butane-1,4-diol diglycidyl ether of epoxide content 7.4 equiv./kg (108 g), itaconic acid (65 g), n-butyl glycidyl ether (28.1 g), N-benzyldimethylamine (2 g), and hydroquinone (0.2 g) were mixed and heated to 120°, when an exothermic reaction set in, the temperature of the mixture rising to 250°. The product was rapidly cooled at 120°, and heated at that temperature for one hour, at which time the epoxy content of the product had fallen to zero. Polyolefin F is substantially of the formula

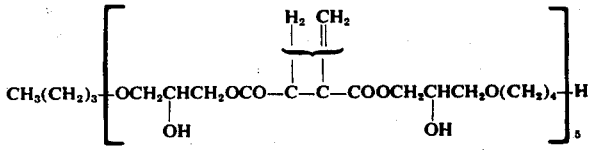

XVI

Polyolefin G

To a stirred solution of Polyol I (200 g) and triethylamine (22 g) in dry acetone (200 g) was added freshly distilled acrylyl chloride (20 g). The mixture was stirred at room temperature for 1 hour and then heated under reflux for 5 hours. Afterwards it was filtered, p-methoxyphenol (0.2 g) was added to inhibit polymerisation, and the solvent was removed under reduced pressure.

Polyolefin G is essentially the triacrylate of Polyol I, i.e., is substantially of the formula

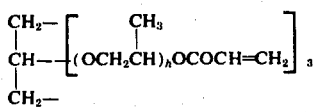

XVII where *h* has a value of 22.5.

Polyolefin H

Acrylic acid (39 g), triethylamine (2.4 g), and hydroquinone (0.2 g) were stirred together at 80° whilst the triglycidyl ether of Polyol II (200 g) was added over 75 minutes. The mixture was stirred for 1 hour further at 80° and then for 3 hours at 120°, at which time its epoxide content had fallen to zero.

Polyolefin H is substantially the tris(3-acrylyl-2-hydroxy-n-propyl) ether of Polyol II, i.e., is substantially of the formula

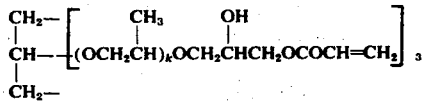

XVIII where *k* is an integer of average value 3.5.

Polyolefin I

Polyolefin I is substantially the tris(3-acrylyloxy-2-hydroxy-n-propyl) ether of Polyol I, and was prepared in the same way as Polyolefin H. It is therefore substantially of formula XVIII, where *k* is an integer of average value 22.5.

Polyolefin J

Polyol III (333 g), succinic anhydride (100 g), and N-benzyldimethylamine (4.3 g) were heated at 120° for 2 hours, then cooled to 60° while allyl glycidyl ether (114 g) and N-benzyldimethylamine (1 g) were added, and the mixture was heated for a further 2 hours at 120°. The product, Polyolefin J, is substantially of the formula

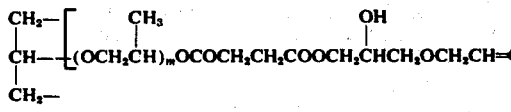

XIX where *m* is an integer of average value 5.2.

Polyolefin K

Polyolefin K was prepared in a similar manner to Polyolefin J except that Polyol IV was used instead of Polyol III. Polyolefin K is substantially of the formula XIX where m is an integer of average value of 2.9.

Polyolefin L

Polyolefin L was prepared from a commercially available di-isocyanate prepolymer based on a poly(tetrahydrofuran) and toluene-di-isocyanate, of isocyanate content 3.9 – 4.3%.

To the isocyanate prepolymer (151 g) was added dry allyl alcohol (12.9 g), and the mixture was stirred for 17 hours at 100° under nitrogen. The excess of ally alcohol was then removed by distillation under a vacuum of 2.5 mm for 8 hours at 100°.

Polyolefin M

A poly(tetrahydrofuran) of average molecular weight 1000 (255 g) was mixed with dibutyltin dilaurate (0.15 g), heated for 1 hour at 110° under a vacuum of 2.5 mm to remove all traces of water present, then the mixture was cooled to 60° and the vacuum was released with dry nitrogen. Allyl isocyanate (41.5 g) was added dropwise so as to maintain the temperature at 60°. After completion of the addition the mixture was maintained at 60° for a further 3 hours. Excess of allyl isocyanate was then removed by vacuum distillation at a pressure of 3.5 mm for 1 hour at 110°.

Polyolefin M is substantially of the formula $$\{CH_2CH_2O(C_4H_8O)_n\ OCNHCH_2CH{=}CH_2\}_2 \qquad \text{XX}$$

where $n$ is an integer of average value 6.3.

Polyolefin N

A poly(oxypropylene) glycol of average molecular weight 750 (375 g) was heated at 110° for 1 hour under a vacuum of 3.5 mm to remove water and other low-boiling materials. The vacuum was released with dry nitrogen and 174 g of toluene di-isocyanate (a commercially-available mixture of 2,4- and 2,6-di-isocyanatotoluene) was added. Heating was continued under nitrogen for 4½ hours at 120°, then the mixture was cooled to 80° and diallylamine (97 g) was added. An exothermic reaction set in and the temperature of the mixture rose to 120°: it was maintained at this temperature for a further hour. Polyolefin N is an allophanate, substantially of the formula

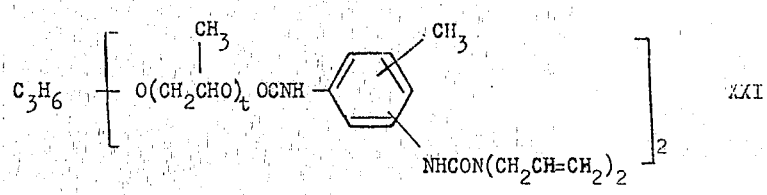

XXI where $t$ is an integer of average value 5.8.

Polyolefin O

A poly(oxypropylene)glycol of average molecular weight 750 (300 g), maleic anhydride (32.66 g), and xylene (66.7 g) were stirred together and heated at reflux (170°) for 1 hour. The solution was cooled to 150°, 3.33 g of toluene-p-sulphonic acid was added, and the mixture was again heated to reflux, water liberated during the reaction being removed by azeotropic distillation. After the mixture had refluxed for a period of 3½ hours 6 ml. of water had been collected and water liberation had ceased. The solution was cooled to 50° and neutralised with aqueous potassium bicarbonate solution. The water and xylene were removed by distillation and the product was filtered. Polyolefin O is substantially of the formula

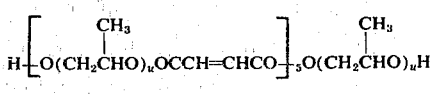

XXII where $u$ is an integer of average value 12.6.

Polyolefin P is diallylamine.

Polyolefin Q is diallyl sulphide.

Polyolefin R is triallyl isocyanurate.

Polythiol A is glycerol tri(thioglycollate)

Polythiol B is pentaerythritol tetra(thioglycollate)

Polythiol C is 1,1,1-trimethylolpropane tri(thioglycollate)

Polythiol D is dipentaerythritol hexa(3-mercaptopropionate)

Polythiol E is ethylene glycol di(thioglycollate)

Polythiol F is the tris(2-mercaptoethyl) ester of trimerised linoleic acid, and was prepared thus:

2-Mercaptoethanol (29.5 g), 100 g of trimerised linoleic acid (average molecular weight approximately 800, carboxyl content 3.42 equiv./kg), 1 g of toluene-p-sulphonic acid, and 150 ml of perchloroethylene were heated to reflux for 16 hours under nitrogen, water liberated during the reaction (7.6 ml) being removed by means of a Dean and Stark trap. The solution was washed with water and the perchloroethylene was distilled off under reduced pressure to leave 111 g of Polythiol F, a pale yellow oil of thiol content 2.2 equiv./kg.

Polythiol G is propane-1,2-diol di(thioglycollate)

Polythiol H is propane-1,3-diol di(thioglycollate)

Polythiol I is dipropylene glycol di(thioglycollate)

Polythiol J is dipentaerythritol tetra(thioglycollate).

Various wetting agents were employed, viz.

Wetting Agent I - an adduct of p-nonylphenol (1 mol.) and ethylene oxide (9 mol.)

Wetting Agent II - an adduct of mixed $C_{16}$ and $C_{18}$ aliphatic n-primary amines (1 mol.) and ethylene oxide (70 mol.)

Wetting Agent III - an adduct of octylphenol (1 mol.) and ethylene oxide (8 mol.)

Wetting Agent IV - similar to Wetting Agent II but contains only 8 mol. of ethylene oxide per mol. of the mixed amines.

Wetting Agent V - a commercially-available reaction product of distilled coconut oil fatty acids (1 mol.) and diethanolamine (2 mol.).

Emulsions of the polythiol ester were made by stirring together, by means of a high speed stirrer, 50 parts of the polythiol ester, 2.5 parts of Wetting Agent I, 47.5 parts of water and, optionally, 0.1–0.5 part of carboxymethylcellulose or hydroxymethylcellulose. Emulsions of the polyolefins were prepared similarly from 50 parts of the polyolefin, 5 parts of Wetting Agent II, 45 parts of water and, optionally, 0.1–0.5 part of carboxymethylcellulose or hydroxymethylcellulose.

The methods of washing the samples were these:

METHOD A

In this method the relaxation and felting shrinkages are measured separately.

A mixture comprising 147 g of sodium dihydrogen phosphate dihydrate, 200 g of disodium hydrogen phosphate, and 12.5 g of Wetting Agent I is diluted to 25 liters with distilled water at 40° in a "Cubex" washing machine. To the solution are added the samples of the keratinous material (not exceeding 500 g) and sufficient cotton as ballast to bring the weight of the load to 1 kg. The contents of the Cubex are rotated for 15 seconds, allowed to stand for 15 minutes, and rotated for 5 minutes; the samples are drained, rinsed with distilled water at 40°, and spun in a spin-dryer. The relaxation shrinkage is the percent change in the area of the samples, calculated from the changes in linear dimensions.

Next, the samples, together with sufficient fresh cotton ballast to make the load up to 1 kg, are replaced in the Cubex and 25 liters of a solution in distilled water, containing 147 g of sodium dihydrogen phosphate dihydrate and 200 g of disodium hydrogen phosphate at 40° are added. The contents are rotated for 30 minutes instead of 5 minutes. The felting shrinkage is similarly calculated from the change from the linear dimensions in the relaxed state.

METHOD B

This is similar to Method A except that the second washing liquor comprises 88.2 g of sodium dihydrogen phosphate dihydrate and 120 g of disodium hydrogen phosphate diluted to 15 liters with distilled water and the second washing period is one hour.

METHOD C

This is the same as Method B except that the second washing period is 3 hours.

METHOD D

The samples are washed at 40° in an English Electric Reversomatic washing machine set on programme 5 with the timing control set on No. 1, the wash liquor being an aqueous solution containing, per liter, 2 g of soap flakes and 0.8 g of anhydrous sodium carbonate, using a liquor sample ratio of about 30:1 by weight. The samples are rinsed in cold water, spun in the machine, and then dried for 30 minutes in a Parnall Tumble Drier on full heat. The samples are then kept for 16 hours at 20° and 65% relative humidity. The area shrinkage (total of relaxation and felting shrinkage) is likewise calculated from the linear shrinkage measurements.

METHOD E

The samples are washed at 40° in an Imperial Super Automatic 85 washing machine set on programme 4 with a wash liquor containing 2 g per liter of Persil Automatic (a low-foaming detergent). The samples are rinsed in cold water and spun in the machine, and then dried for 15 minutes in an English Electric Tumble Drier on full heat. The samples are then kept for 16 hours at 20° and 65% relative humidity. The area shrinkage (total of relaxation and felting shrinkage) is likewise calculated from the linear shrinkage measurements.

To conform with International Wool Secretariat (IWS) Specifications 7*b* and 71, wool cloth washed in accordance with Methods A and B, respectively, should have an area felting shrinkage of less than 5%: for it to confirm with IWS Specification 72, the area relaxation and felting shrinkage should each be less than 8% when the cloth is washed in accordance with Method C.

EXAMPLE I

The cloth used was a wool flannel weighing approximately 170 g per square meter: the pH of its aqueous extract was 7.1. Samples of the flannel were padded to an uptake of 300% with a solution in perchloroethylene (Experiments 1–15 and 22–24) containing the compounds listed in Table I. The amounts of the polythiol ester, the polyene, and the catalyst are expressed as a percentage of the weight of the flannel sample. Experiments 16–21 were conducted similarly except that the components were applied from aqueous emulsion. Then the samples were dried at 65° in a fanned oven for 15 minutes and stored at room temperature and humidity.

At intervals of from 1 to 22 days after the samples had been impregnated they were washed and dried according to Method D.

Untreated cloth shrank in area by an average of 22.9%. Results obtained with samples treated in accordance with the method of this invention are shown in Table I. Experiments 1 and 2 are for purposes of comparison.

TABLE I

| Expt. No. | Polythiol % | | Polyene % | | Catalyst % | | Area Shrinkage (%) after days 1 | 2 | 8 | 22 |
|---|---|---|---|---|---|---|---|---|---|---|
| 1 | — | — | B | 3.0 | DETA[1] | 0.15 | 19.9 | 18.1 | — | 20.8 |
| 2 | — | — | B | 3.0 | PDA[2] | 1.5 | 21.7 | 22.6 | 22.2 | — |
| 3 | A | 0.2 | B | 3.0 | DETA | 0.12 | 12.2 | — | 9.3 | — |
| 4 | A | 0.5 | B | 3.0 | DETA | 0.12 | 10.8 | — | 6.5 | — |
| 5 | A | 0.2 | B | 3.0 | TSA[3] | 0.1 | — | — | 7.4 | 6.4 |
| 6 | A | 0.5 | B | 3.0 | TSA | 0.1 | — | — | 7.4 | — |
| 7 | B | 0.2 | B | 3.0 | DETA | 0.12 | 8.8 | 8.4 | 7.9 | 7.9 |
| 8 | B | 0.4 | B | 3.0 | DETA | 0.12 | 6.9 | 5.4 | — | 4.9 |
| 9 | C | 0.4 | B | 3.0 | DETA | 0.12 | 9.8 | 6.4 | — | 3.5 |
| 10 | A | 0.5 | E | 3.0 | DETA | 0.12 | 6.5 | — | 4.0 | 4.5 |
| 11[4] | B | 0.5 | E | 3.0 | DETA | 0.12 | 8.8 | — | 6.9 | — |
| 12 | B | 0.1 | G | 3.0 | DETA | 0.12 | — | — | 7.9 | 5.5 |
| 13 | B | 0.2 | G | 3.0 | DETA | 0.12 | 5.0 | 4.0 | 3.5 | — |
| 14 | A | 0.8 | I | 8.0 | DETA | 0.16 | 4.0 | 3.5 | — | — |
| 15 | A | 0.3 | I | 3.0 | TSA | 0.1 | — | 10.4 | — | — |
| 16[5] | B | 0.2 | B | 3.0 | DETA | 0.12 | 9.3 | — | 9.3 | 9.3 |
| 17[5] | B | 0.2 | B | 3.0 | TEA[6] | 0.3 | 11.2 | — | — | 10.7 |
| 18[5] | B | 0.5 | E | 3.0 | DETA | 0.24 | 9.3 | — | — | 9.8 |
| 19[5] | B | 0.3 | G | 3.0 | DETA | 0.12 | — | — | 10.7 | 10.7 |
| 20[5] | E | 0.6 | A | 2.4 | DETA | 0.06 | 12.6 | 5.4 | — | — |

TABLE I-continued

| Expt. No. | Polythiol | % | Polyene | % | Catalyst | % | Area Shrinkage (%) after days 1 | 2 | 8 | 22 |
|---|---|---|---|---|---|---|---|---|---|---|
| 21[5] | E | 1.0 | H | 3.0 | DETA | 0.12 | — | — | 10.7 | — |
| 22 | D | 0.5 | D | 3.0 | DETA | 0.18 | 12.6 | — | — | — |
| 23 | B | 0.5 | C | 2.4 | DETA | 0.18 | 12.1 | 9.3 | — | — |
| 24 | F | 1.5 | F | 1.5 | DETA | 0.18 | 13.1 | — | 11.7 | — |

[1]DETA = diethylenetriamine
[2]PDA = a poly(oxypropylene)diamine of average mol. wt 2000
[3]TSA = toluene-p-sulphonic acid monohydrate
[4]cured for 5 minutes at 150°
[5]cured by steaming with a steam-iron for 2½ minutes
[6]TEA = triethanolamine

EXAMPLE II

Wool flannel was impregnated to 100% pickup with a composition comprising 50 g of the 50% aqueous emulsion of Polyolefin A, 10 g of the 50% aqueous emulsion of Polythiol A, 2 g of Wetting Agent III, and 838 g of water. The wool was heated for 4 minutes at 120°, when it met the requirements of IWS Specification 72.

EXAMPLE III

Wool yarn (50 kg) was impregnated in a centrifuge with a liquor comprising, per kg, 100 g of the 50% aqueous emulsion of Polyolefin A, 20 g of the 50% aqueous emulsion of Polythiol A, 2 g of anhydrous sodium carbonate, 2 g of Wetting Agent III, and 876 g of water. The take-up was adjusted to 40% by centrifuging the yarn. The yarn could also be treated by impregnating in an apparatus wherein it is transported by means of moving belts (which may be perforated) and then pressed between rollers. The treated yarn was dried at 80° for 15 minutes on a can-dryer. Knitwear made up from this yarn met the requirements of IWS Specification 72.

In place of Polythiol A, Polythiols G or H could be used.

EXAMPLE IV

The wool flannel used in Example I was padded with a perchloroethylene solution containing either Polyolefin A or Polyolefin B, such that the uptake of the polyene was 3.0%. The cloth was dried at its original dimensions for 10 minutes at 60°. Some pieces of the treated cloth were then padded with a perchloroethylene solution of Polythiol B and diethylenetriamine such that the uptake of the polythiol ester was 0.5% and of diethylenetriamine, 0.06%. Other treated patterns were padded with a perchloroethylene solution of diethylenetriamine such that the uptake of amine was 0.06%. The pieces of cloth were dried as before. The cloth was stored for various periods, then washed according to Method D and the percentage area shrinkage was calculated. The results are shown in Table II.

TABLE II

| Polyene | After-treatment | Area shrinkage (%) after 1 day | 2 days |
|---|---|---|---|
| 3.0% A | 0.06% DETA | 22.7 | 20.9 |
| 3.0% | 0.5% Polythiol B + 0.06% DETA | 8.8 | 7.9 |
| 3.0% B | 0.06% DETA | 23.6 | 23.1 |
| 3.0% B | 0.5% Polythiol B + 0.06% DETA | 7.9 | 7.9 |
| Untreated | | 24.9 | 22.2 |

EXAMPLE V

A fabric comprising a 70/30 blend of wool and polyacrylonitrile fibres, weighing 380 g per sq. meter, was treated to an uptake of 300% with a trichloroethylene solution containing 0.9% of Polyolefin A, 0.1% of Polythiol I, and 0.04% of diethylenetriamine. The fabric was dried for 15 minutes at 80° at its original dimensions, then was washed according to Method C: its area felting shrinkage was found to be 1.9%, while a similar piece of untreated material had an area felting shrinkage of 9.2% when subjected to this washing test.

EXAMPLE VI

This Example describes the application by exhaustion.

Wool flannel (20 g samples) was scoured for 30 minutes at 40° at a liquor ratio of 30:1 with a liquor of pH 7.0 containing 1 g of Wetting Agent V per liter.

The wool was thoroughly rinsed with water and spun dry. The wool samples were rolled into cylinders and each was placed in a cage of a Horsfall laboratory dyeing machine. The treatment liquors (see Table III) consisted of a mixture of emulsions of a polyene and a polythiol ester and 3% of formic acid (on the weight of wool). The cages containing the wool samples were placed in the liquor which was mechanically agitated for 30 minutes at 25° to allow the polyene and the polythiol ester to exhaust onto the wool.

At the end of the treatment the liquors, which were originally milky in appearance, had become "water white", indicating that exhaustion was complete. Next, 1.5%, calculated on the weight of the wool, of a cationic polyaminoamide-epichlorohydrin resin of 20% solids content (made as described in Example 1 of U.S. Pat. No. 2,926,154 from diethylenetriamine with adipic acid and epichlorohydrin) was added to each of the liquors and treatment was continued at 25° for a further 10 minutes. Sodium carbonate (see Table III) was then added to each of the liquors and treatment was continued for a further 30 minutes. The samples were removed from the cages, spun, and dried for 30 minutes at 80°, and their shrinkage properties were then assessed by washing, using Method B or E.

TABLE III

| Polythiol designation | % | Polyene designation | % | % $Na_2CO_3$ | Washing method | % Shrinkage |
|---|---|---|---|---|---|---|
| C | 0.6 | A | 3.0 | 3.75 | E | 7.6 |
| D | 0.6 | A | 3.0 | 7.5 | E | 9.5 |
| B | 0.6 | A | 3.0 | 7.5 | B | 8.4 |
| — | — | A | 3.0 | 7.5 | B | 33.7 |
| Control | — | — | — | — | B | 30.5 |
| Control | — | — | — | — | E | 27.6 |

EXAMPLE VII

Samples of wool flannel similar to that used in Example I were padded to an uptake of 300% with a solution in trichloroethylene containing the components listed in Table IV. The samples were dried in a fanned oven for 15 minutes at 80° at their original dimensions: those containing toluene-p-sulphonic acid were also heat-cured for 5 minutes at 145°. The samples were washed according to Method B and their area felting shrinkages were recorded.

TABLE IV

| Polythiol designation | % | Polyene designation | % | Catalyst | % | Area felting shrinkage |
|---|---|---|---|---|---|---|
| B | 1.10 | J | 2.45 | TSA | 0.3 | 1.3 |
| B | 1.0 | M | 2.5 | TSA | 0.3 | −0.6 |
| B | 0.89 | N | 2.19 | TSA | 0.3 | 1.8 |
| B | 0.84 | L | 2.58 | TSA | 0.3 | −0.7 |
| B | 1.24 | K | 2.38 | TSA | 0.3 | 1.4 |
| B | 2.15 | P | 0.85 | TSA | 0.3 | 1.8 |
| B | 1.66 | P | 1.34 | TSA | 0.3 | −3.5 |
| B | 2.06 | Q | 0.94 | TSA | 0.3 | 8.7 |
| B | 0.66 | O | 2.67 | DETA | 0.12 | 0.4 |
| B | 1.80 | R | 1.20 | TSA | 0.3 | 11.5 |
| Untreated | — | — | — | — | — | 18.8 |

EXAMPLE VIII

Wool flannel was padded to 70% uptake with a solution containing 47.6 g of the 50% aqueous emulsion of Polyolefin N, 24.8 g of Polythiol B, 3 g of either toluene-p-sulphonic acid or sulphuric acid, and 625 g of water, and then dried for 15 minutes at 80°. It was then cured according to the conditions given in Table V, washed according to Method B, and the relaxation and area felting shrinkages were recorded.

In place of Polythiol B, Polythiol J could be used.

TABLE V

| Catalyst | Cure conditions | % Relaxation shrinkage | % Area felting shrinkage |
|---|---|---|---|
| TSA | 5 minutes at 120° | 2.5 | 1.9 |
| $H_2SO_4$ | 7 days at 18° | 3.2 | 0.0 |
| $H_2SO_4$ | 2 minutes at 140° | 2.6 | 0.2 |
| Untreated | — | 10.5 | 29.3 |

EXAMPLE IX

In this Example the use of free radical catalysts is demonstrated.

A wool flannel similar to that used in Example I but yielding an aqueous extract of pH 5.5 was padded to 300% uptake with a trichloroethylene solution containing 0.86% of Polyolefin L, 0.28% of Polythiol B, and either 0.033% of benzoyl peroxide or 0.033% of di-isopropyl peroxydicarbonate. The treated flannel was dried in a fanned oven at 80° for 15 minutes and then heated for 5 minutes at 150°. Portions of the treated material and an untreated control were then washed according to Method B and the following results were recorded.

| Catalyst | % Area felting shrinkage |
|---|---|
| Benzoyl peroxide | 4.6 |
| Di-isopropyl peroxydicarbonate | 5.7 |
| Untreated | 36.5 |

EXAMPLE X

A pure wool double knit fabric was padded to 90% uptake with a composition containing 80 parts of a 50% aqueous emulsion of Polyolefin A, 20 parts of a 50% aqueous emulsion of Polythiol A, 2 parts of Wetting Agent I, 10 parts of anhydrous sodium carbonate, and 888 parts of water. The fabric was dried for 3 minutes at 140°, and met the requirements of IWS Specification 72.

EXAMPLE XI

A wool cloth was impregnated with an aqueous solution containing 50 g per liter of monoethanolamine sulphite and 5 g per liter of monoethanolamine to 100% uptake, and then dried. This treatment served to impart better flat-set properties. To make the cloth shrink-resistant it was then padded to an uptake of 80% with a composition comprising 80 parts of a 50% aqueous emulsion of Polyolefin A, 15 parts of a 50% aqueous emulsion of Polythiol E, 2 parts of Wetting Agent I, 8 parts of anhydrous sodium carbonate and 895 parts of water. The cloth was heated for 5 minutes at 120° and had flat-set properties as well as being shrink-resistant. It met the requirements of IWS Specification 72. Permanent pleats could be inserted in trousers or skirts made from the cloth by spraying it before pressing in the area to be pleated with the above mixture of monoethanolamine and monoethanolamine sulphite.

EXAMPLE XII

In winch-dyeing of woven or knitted fabrics there is always the risk that rope marks are formed which are almost impossible to remove; also, the material may become felted. By following the procedure described below, which is applicable not only to pure wool but to blends with cellulose or synthetic fibres, these difficulties were overcome.

A pure wool double knit fabric was padded to 70% uptake in a mixture comprising 50 parts of a 50% aqueous emulsion of Polyolefin A, 70 parts of a 50% aqueous emulsion of Polythiol H, 8 parts of anhydrous sodium carbonate, and 892 parts of water, then it was dried for 2 minutes at 140°. The fabric was then winch-dyed under weakly acid conditions with a reactive dyestuff or a 1:2 metal complex dyestuff and dried; it did not felt (it met the requirements of IWS Specification 72) and was free from rope marks.

We claim:

1. A process for imparting shrink-proof and durable press properties to keratinous material which comprises 1. treating the material with a polythiol ester of the formula

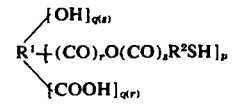

where $R^1$ represents an aliphatic or araliphatic hydrocarbon radical of at least 2 carbon atoms, or an aliphatic or araliphatic hydrocarbon radical of at least 2 carbon atoms which contains one ether oxygen atom, $R^2$ represents an alkylene group of at most 6 carbon atoms, $p$ is an integer of from 2 to 6, $q$ is zero or a positive integer of at most 3, such that $(p + q)$ is at most 6, and $r$ and $s$ each represent zero or 1 but are not the same, and 2. causing the polythiol ester to cure on the material by reaction with a polyene having a molecular weight of at least 250 and at most 10000 and containing, per average molecule, at least two ethylenic double bonds each $\beta$ to an oxygen or nitrogen atom, the sum of such ethylenic double bonds in the polyene and of the mercaptan groups in the polythiol ester being more than 4 and at most 8, the combined weight of the polyene and the polythiol ester being from 0.5 to 15% by weight of the keratinous material treated, and the amount of the polyene being such as to supply up to 1.2 ethylenic double bonds per mercaptan group of the polythiol ester.

2. Process according to claim 1, in which the amount of polyene is such as to supply from 0.5 to 0.75 ethylenic double bond per mercaptan group.

3. Process according to claim 1, in which the treated fabric is heated at a temperature in the range 35° to 180°C.

4. Process according to claim 1, in which the polyene contains at least two ethylenic double bonds each $\alpha$ to a carbonyloxy group.

5. Process according to claim 4, in which the polyene is of the formula $$R^3\left[(\text{O-alkylene})_d\text{—O—}(CH_2\underset{\underset{R^4}{|}}{C}HCH_2O)_b\text{—}R^5\right]_c$$

where $d$ is zero or a positive integer of value such that the average molecular weight of the polyene does not exceed 10000, $b$ is zero or 1, $c$ is an integer of at least 1 and at most 6, $R^3$ denotes the radical remaining after removal of $c$ OH groups from a compound having at least $c$ alcoholic or phenolic hydroxyl groups or the acyl radical remaining after removal of $c$ OH groups from a compound having at least $c$ COOH groups, each 'alkylene' group contains a chain of at least 2 and at most 6 carbon atoms between consecutive oxygen atoms, $R^4$ represents a group of formula —OH or —$OOCR^6$, $R^5$ represents —H, an acyl group, or the residue, after removal of an —OH group, of an alcohol, with the provisos that $R^3$ and $R^5$ do not both represent acyl when $b$ and $d$ both denote zero and that $R^5$ does not represent —H when $b$ is 1, and $R^6$ represents —H or a monovalent hydrocarbon group of 2 to 16 carbon atoms and bearing either one —COOH group or one alkoxycarbonyl group containing from 1 to 13 carbon atoms, there being a total of at least two ethylenic bonds $\alpha$ to carbonyloxy groups in the polyene.

6. Process according to claim 5, in which $R^3$ represents an aliphatic radical containing up to 60 carbon atoms or a radical of the formula

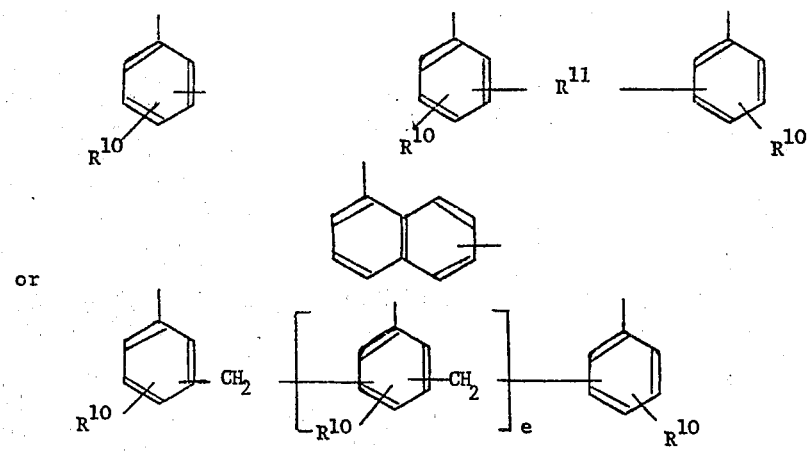

where $R^{10}$ denotes —H, —Cl, —Br, or an alkyl or alkenyl group of 1 to 9 carbon atoms, $R^{11}$ denotes a carbon-carbon bond, an alkylene hydrocarbon group of from 1 to 4 carbon atoms, or an ether oxygen atom, and $e$ is an integer of from 1 to 4.

7. Process according to claim 1, in which the polythiol ester is of the formula $$R^1\left\langle\begin{matrix}[OH]_q\\ \\ [O\text{—}CO\text{—}R^2\text{—}SH]_p\end{matrix}\right.$$

where $R^1$, $R^2$, $p$, and $q$ have the meanings assigned in claim 1.

8. Process according to claim 1, in which the polythiol ester is of the formula

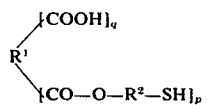

where $R^1$, $R^2$, $p$, and $q$ have the meanings assigned in claim 1.

9. Process according to claim 1, in which $R^1$ denotes an aliphatic hydrocarbon radical of at most 6 carbon atoms.

10. Process according to claim 1, in which the polyene and the polythiol ester are employed in the presence of 0.1 to 20% by weight, calculated on the total weight of the polyene and polymercaptan, of a Bronsted base as catalyst.

11. Process according to claim 1, in which the polyene and the polythiol ester are employed in the presence of 0.1 to 20% by weight, calculated on the total weight of the polyene and polymercaptan, of a Bronsted acid or a free-radical catalyst.

12. Keratinous material bearing thereon 0.5 to 15% by weight, calculated on the weight of the keratinous material, of a cured product comprising a polythiol ester of the formula

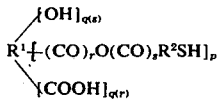

where $R^1$ represents an aliphatic or araliphatic hydrocarbon radical of at least 2 carbon atoms, or an aliphatic or araliphatic hydrocarbon radical of at least 2 carbon atoms which contains one ether oxygen atom, $R^2$ represents an alkylene group of at most 6 carbon atoms, $p$ is an integer of from 2 to 6, $q$ is zero or a positive integer of at most 3, such that $(p + q)$ is at most 6, and $r$ and $s$ each represent zero or 1 but are not the same, and a polyene having a molecular weight of at least 250 and at most 10000 and containing, per average molecule, at least two ethylenic double bonds each $\beta$ to an oxygen or nitrogen, atom, the sum of such ethylenic double bonds in the polyene and of the mercaptan groups in the polythiol ester being more than 4 and at most 8.

13. Keratinous material according to claim 12, in which the polyene contains at least two ethylenic double bonds each $\alpha$ to a carbonyloxy group.

14. Keratinous material according to claim 12, in which the polyene is of the formula

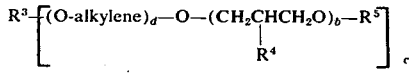

where $d$ is zero or a positive integer of value such that the average molecular weight of the polyene does not exceed 10000.

$b$ is zero or 1, $c$ is an integer of at least 1 and at most 6, $R^3$ stands for the radical remaining after removal of $c$ OH groups from a compound having at least $c$ alcoholic or phenolic hydroxyl groups or the acyl radical remaining after removal of $c$ OH groups from a compound having at least $c$ COOH groups, each 'alkylene' group contains a chain of at least 2 and at most 6 carbon atoms between consecutive oxygen atoms, $R^4$ represents a group of formula —OH or —$OOCR^6$, $R^5$ represents —H, an acyl group, or the residue, after removal of an —OH group, of an alcohol, with the provisos that $R^3$ and $R^5$ do not both represent acyl when $b$ and $d$ both denote zero and that $R^5$ does not represent —H when $b$ is 1, and $R^6$ represents —H or a monovalent hydrocarbon group of 2 to 16 carbon atoms and bearing either one —COOH group or one alkoxycarbonyl group containing from 1 to 13 carbon atoms, there being a total of at least two ethylenic bonds $\alpha$ to carbonyloxy groups in the polyene.

15. Keratinous material according to claim 12, in which $R^3$ represents an aliphatic radical containing up to 60 carbon atoms or a radical of the formula

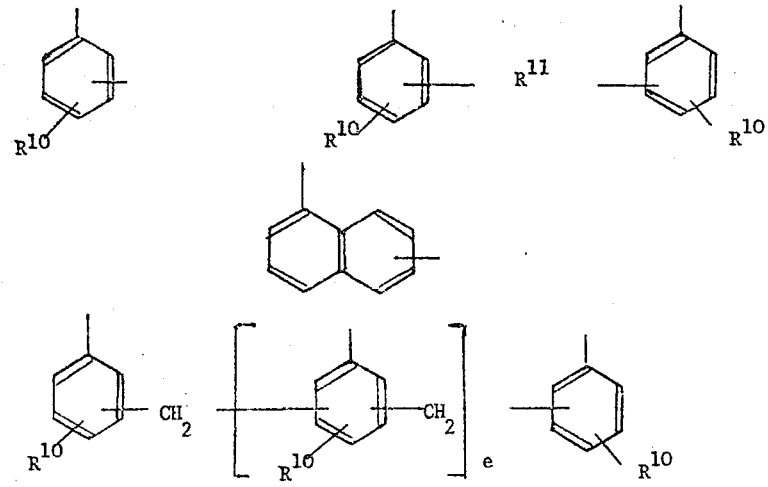

where $R^{10}$ denotes —H, —Cl, —Br, or an alkyl or alkenyl group of 1 to 9 carbon atoms, $R^{11}$ denotes a carbon-carbon bond, an alkylene hydrocarbon group of from 1 to 4 carbon atoms, or an ether oxygen atom, and

*e* is an integer of from 1 to 4.

16. Keratinous material according to claim 12, in which the polythiol ester is of the formula

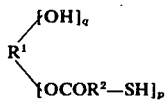

where $R^1$, $R^2$, *p*, and *q* have the meanings assigned in claim 12.

17. Keratinous material according to claim 12, in which the polythiol ester is of the formula

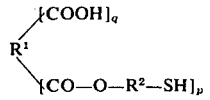

where $R^1$, $R^2$, *p*, and *q* have the meanings assigned in claim 12.

18. Keratinous material according to claim 12, in which $R^1$ denotes an aliphatic radical of at most 6 carbon atoms.

* * * * *